US006626965B2

(12) United States Patent
Workman et al.

(10) Patent No.: US 6,626,965 B2
(45) Date of Patent: Sep. 30, 2003

(54) APPARATUS FOR FORMING DIE CUTS AND METHOD OF MANUFACTURING SAME

(75) Inventors: Robert E. Workman, Spanish Fork, UT (US); David L. Hughes, Jr., Rancho Santa Margarita, CA (US); Kevin L. Corcoran, Mission Viejo, CA (US); Faye Angevine, Taipei (TW); Huang Lin-Sheng, Yangdong (CN)

(73) Assignee: Provo Craft & Novelty, Inc., Provo, UT (US)

( * ) Notice: Subject to any disclaimer, the term of this patent is extended or adjusted under 35 U.S.C. 154(b) by 18 days.

(21) Appl. No.: 09/896,667

(22) Filed: Jun. 29, 2001

(65) Prior Publication Data

US 2003/0000354 A1 Jan. 2, 2003

(51) Int. Cl.[7] ..... B21K 5/20; B26D 7/00

(52) U.S. Cl. ..... 8/856; 83/698.91; 83/857; 83/694; 83/697; 83/55; 83/50; 76/107.1; 76/107.8

(58) Field of Search ..... 83/698.91, 856, 83/857, 694, 55, 50; 76/107.1, 107.8

(56) References Cited

U.S. PATENT DOCUMENTS

| | | | | | |
|---|---|---|---|---|---|
| 2,703,023 | A | * | 3/1955 | Sarno | 76/107.8 |
| 2,821,871 | A | * | 2/1958 | Sarno | 76/107.8 |
| 2,885,933 | A | * | 5/1959 | Phillips | 493/476 |
| 3,170,358 | A | * | 2/1965 | Martin | 83/673 |
| 3,182,530 | A | * | 5/1965 | Scott et al. | 76/107.8 |
| 3,228,263 | A | * | 1/1966 | Bien | 76/107.8 |
| 3,383,969 | A | * | 5/1968 | Saunders | 83/663 |
| 3,587,382 | A | | 6/1971 | Boyd | |
| 4,052,886 | A | * | 10/1977 | Buick | 493/468 |
| 4,444,075 | A | | 4/1984 | Mulry | |
| 4,625,592 | A | | 12/1986 | Bayens | |
| 4,981,061 | A | * | 1/1991 | Hillock et al. | 83/697 |
| 5,140,872 | A | * | 8/1992 | Holliday et al. | 76/107.8 |
| 5,275,076 | A | * | 1/1994 | Greenwalt | 83/698.31 |
| 5,778,748 | A | | 7/1998 | Beijen | |
| 6,170,376 | B1 | * | 1/2001 | Strobel et al. | 83/651 |

FOREIGN PATENT DOCUMENTS

| | | |
|---|---|---|
| JP | 04-217497 | 8/1992 |
| JP | 11-034184 | 2/1999 |
| JP | 2000-127095 | 5/2000 |

* cited by examiner

*Primary Examiner*—Derris H. Banks
*Assistant Examiner*—Dmitry Suhol
(74) *Attorney, Agent, or Firm*—Morriss O'Bryant Compagni, P.C.

(57) ABSTRACT

A die cutting block for forming die cuts from paper and other materials includes a base portion having a recess formed therein having a desired shape formed therein, an insert portion having an outer contour which substantially matches the contour of the recess and a blade interposed between and tightly held between the base portion and the insert portion. The blade extends above the base portion and insert portion to provide an exposed edge for cutting paper and the like into a desired shape.

38 Claims, 13 Drawing Sheets

APPARATUS FOR FORMING DIE CUTS AND METHOD OF MANUFACTURING SAME

BACKGROUND

1. Field of the Invention

The present invention relates to an apparatus for forming die cuts. More particularly, the present invention relates to an apparatus for holding a die cutting blade having a desired pattern.

2. Description of the Prior Art

Die cuts are preformed pieces of paper or other cuttable material that are cut into a desired shape. For example, die cuts are often available in various shapes such as teddy bears, hearts, stars, etc. Multiple die cuts are usually packaged together for consumer purchase and may include die cuts formed from various colors of paper.

The die cuts are formed by pressing a blade, which has been formed into the desired shape, against a sheet of paper or any other cuttable material to cut or punch out a section of the paper or other material corresponding to the shape of the blade. The blade is held in position by a block of wood.

As shown in FIGS. 1 and 2, such die cutting blocks 1 are typically comprised of a block of wood 2 which has a desired pattern laser cut into the wood block 2. The laser cutting process forms a channel 3 in the wood block 2 for receiving a die cutting blade 4. The channel 3 extends completely through the wood block 2 but is discontinuous at points 5, 6, 7 and 8 to keep the interior "cut out" portion 9 of the wood block intact with the remainder of the block 2. A preformed blade 4, having a generally rectangular shape, bent to have the same pattern as the pattern cut in the wood block 2 is then inserted into the channel 3 formed therein.

Typically, the wood block 2 is approximately ⅝ to ¾ inches in thickness and the blade 4 is approximately 1 inch in width.

In order to ensure that the blade 4 remains secured within the channel, the blade 4 is essentially press fitted within the channel 3. Moreover, the desired shape is typically formed from several sections of blade 4, each of which must be individually and precisely forced into the channel 3. In order to insert the blade members, a skilled laborer must pound each of the individual blade members into the channel by hand. The blade 4 is forced into the wood block 2 until the back edge 11 of the blade 4 is substantially flush with or even extending slightly beyond the back side 13 of the wood block 2, leaving a portion of the blade 4 extending above the top surface 15 of the wood block 2. With the exception of laser cutting the channel 3 into the block 2, such die cutting blocks 1 have been manufactured in this manner for decades with little, if any, improvement in the manufacturing or assembly processes.

This process of manufacturing such a die cutting instrument is time consuming and labor intensive. As such, the cost to manufacture each die cutting block is relatively high. The retail price of such die cutting blocks have an average retail price of approximately $120 dollars. The primary market for such die cutting blocks are commercial establishments that produce their own sets of die cuts or commercial establishments that allow their customers to use their die cutting machines to create die cuts for a fee. There has not been a die cutting system designed specifically for personal or home use.

Thus, it would be advantageous to provide a die cutting block that is easy to manufacture, easy to assemble, and relatively inexpensive. It would further be advantageous to provide a die cutting block that can be manufactured at a price that makes it accessible to the average consumer for home use.

These and other advantages will become apparent from a reading of the following summary of the invention and description of the preferred embodiments in accordance with the principles of the present invention.

SUMMARY OF THE INVENTION

Accordingly, a die cutting block configured for cutting one or more sheets of paper is comprised of a base portion having a top surface and an inner wall surface. The inner wall surface defines an aperture and has a ledge portion depending inwardly from the inner wall surface. A blade is partially inserted within the aperture and rests upon the ledge. The blade also extending above the top surface and defines a top planar edge for forming a desired shape when the top edge of the blade is firmly pressed against a sheet of paper. An insert portion is inserted within the base portion and wedges the blade within the base portion.

The base portion and the insert portion are preferably comprised of plastic. In addition, the aperture in the base portion, the blade and the insert portion each have substantially the same shape.

In yet another embodiment, the base portion is comprised of a top plate, a perimeter wall depending from the top plate, and an inner wall depending from the top plate around the aperture.

In still another embodiment, the ledge portion depends inwardly from the inner wall proximate a lower end thereof and extends completely around the inner wall surface.

In yet another embodiment, the insert defines a first outer surface having a size and shape to substantially match the size and shape of the aperture with the size of the first outer surface being sufficient to wedge the blade against the inner wall surface of the base portion.

In one embodiment, the insert portion includes a wedge portion at a lower end thereof sized to engage with an inner surface of the ledge portion for holding the insert portion relative to the base portion. In a preferred embodiment, the inner surface of the ledge portion is inwardly tapered from proximate its top to proximate its bottom. In another preferred embodiment, the wedge portion is inwardly tapered from proximate its top to proximate its bottom.

In another embodiment, the base portion is comprised of a top plate, a perimeter wall depending from said top plate, and an inner wall depending from the top plate with the inner wall defining said recess. An abutment comprises a ledge portion depending inwardly from the inner wall proximate a lower end thereof.

In yet another embodiment, the abutment ledge portion extends substantially completely around the inner wall surface.

In still another embodiment, the abutment ledge portion forms a bottom plate member.

In another embodiment, the insert defines at least one slot therein and further includes at least one additional blade held within the slot.

In another embodiment, the blade includes a cutting edge for forming perforations.

In still another embodiment, the slot is entirely interior to the insert.

In another embodiment, a second insert is inserted within the recess and a second blade is interposed between the first and second inserts.

In another embodiment, the second insert is received within the first insert.

BRIEF DESCRIPTION OF THE DRAWINGS

The foregoing summary, as well as the following detailed description of the preferred embodiments is better understood when read in conjunction with the appended drawings. For the purpose of illustrating the invention, there is shown in the drawings embodiments that are presently preferred and which illustrate what is currently considered to be the best mode for carrying out the invention, it being understood, however, that the invention is not limited to the specific methods and instruments disclosed. In the drawings.

DETAILED DESCRIPTION OF THE PREFERRED EMBODIMENTS

Figure 1:
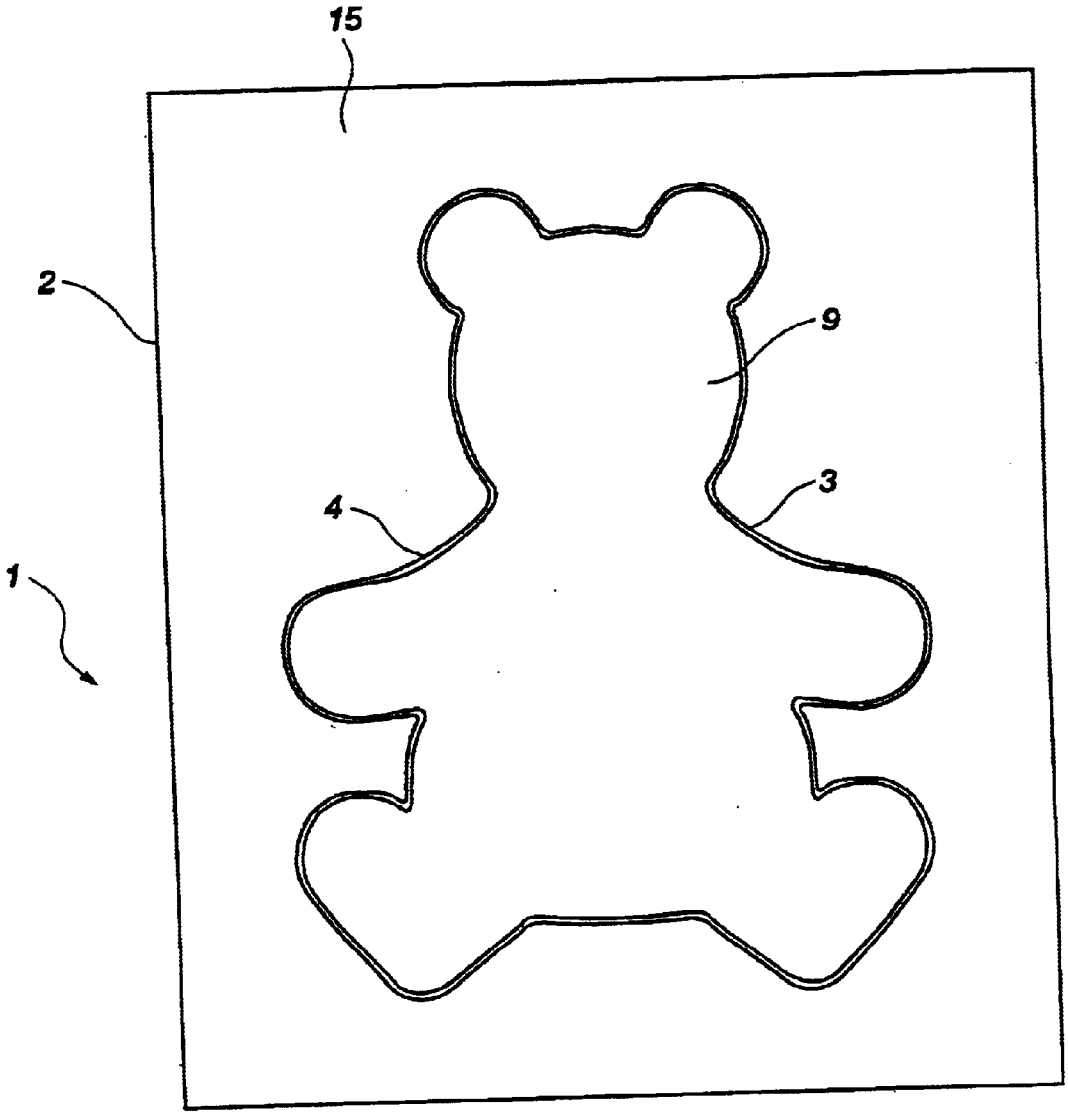
Fig. 1 (PRIOR ART)
FIG. 1 is front view of the a prior art die cutting block.
Figure 2:
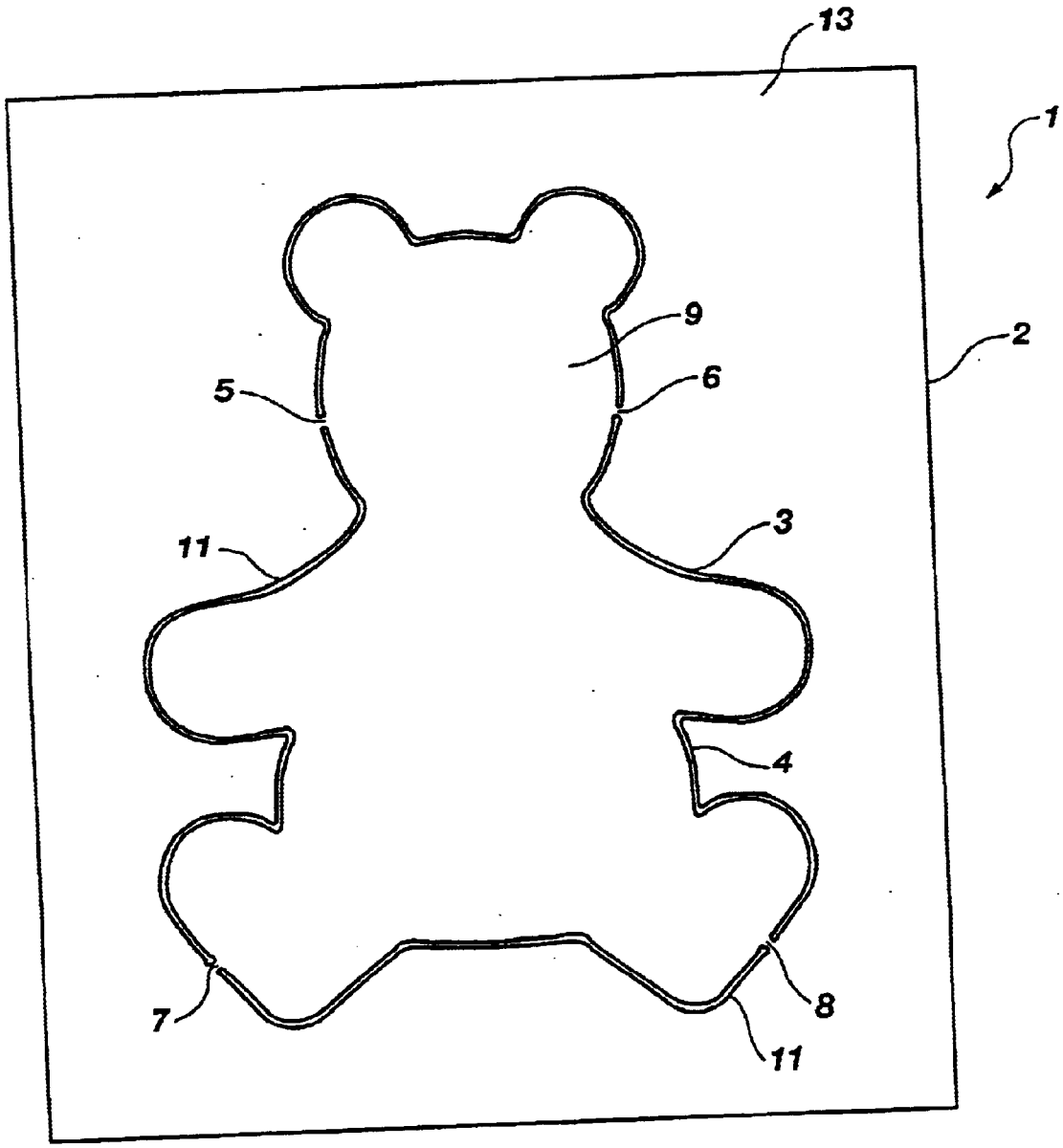
Fig. 2 (PRIOR ART)
FIG. 2 is a back view of the prior art die cutting block shown in FIG. 1.
Figure 3A:
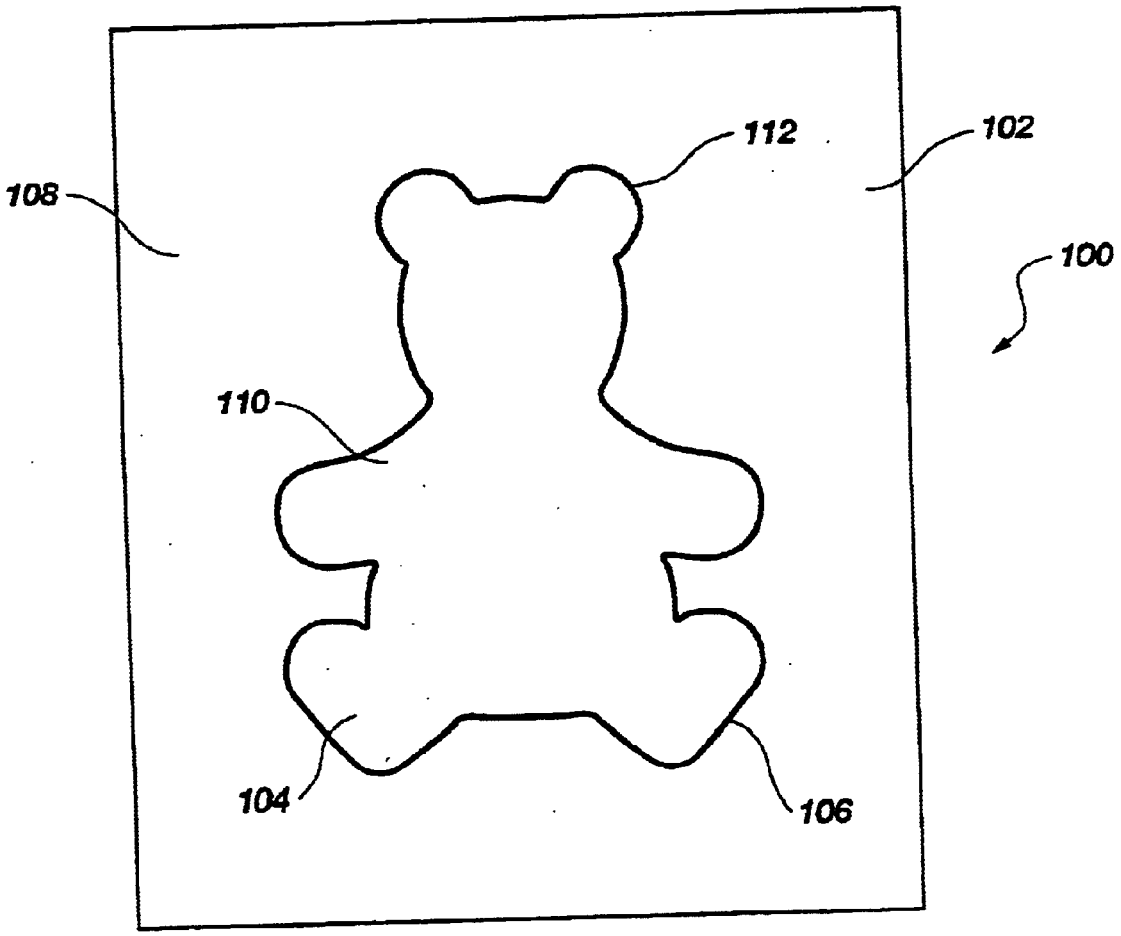
FIG. 3A is a front view of a first embodiment of a die cutting block in accordance with the principles of the present invention.

Referring to the drawings wherein like numerals indicate like elements throughout, there is shown in FIG. 3A a die cutting block, generally indicated at 100, in accordance with the principles of the present invention. The die cutting block is comprised of a base portion 102, an insert portion 104 and a blade 106 extending above the top surfaces 108 and 110 of the base portion and insert portion, respectively. The blade 106 is rigidly held between the base portion 102 and the insert portion 104. The base portion 102 and insert portion 104 when pressed together against the blade 106, which is interposed therein between, prevent the blade from become dislodged once the die cutting block 100 is assembled in accordance with the principles of the present invention.

Figure 3B:
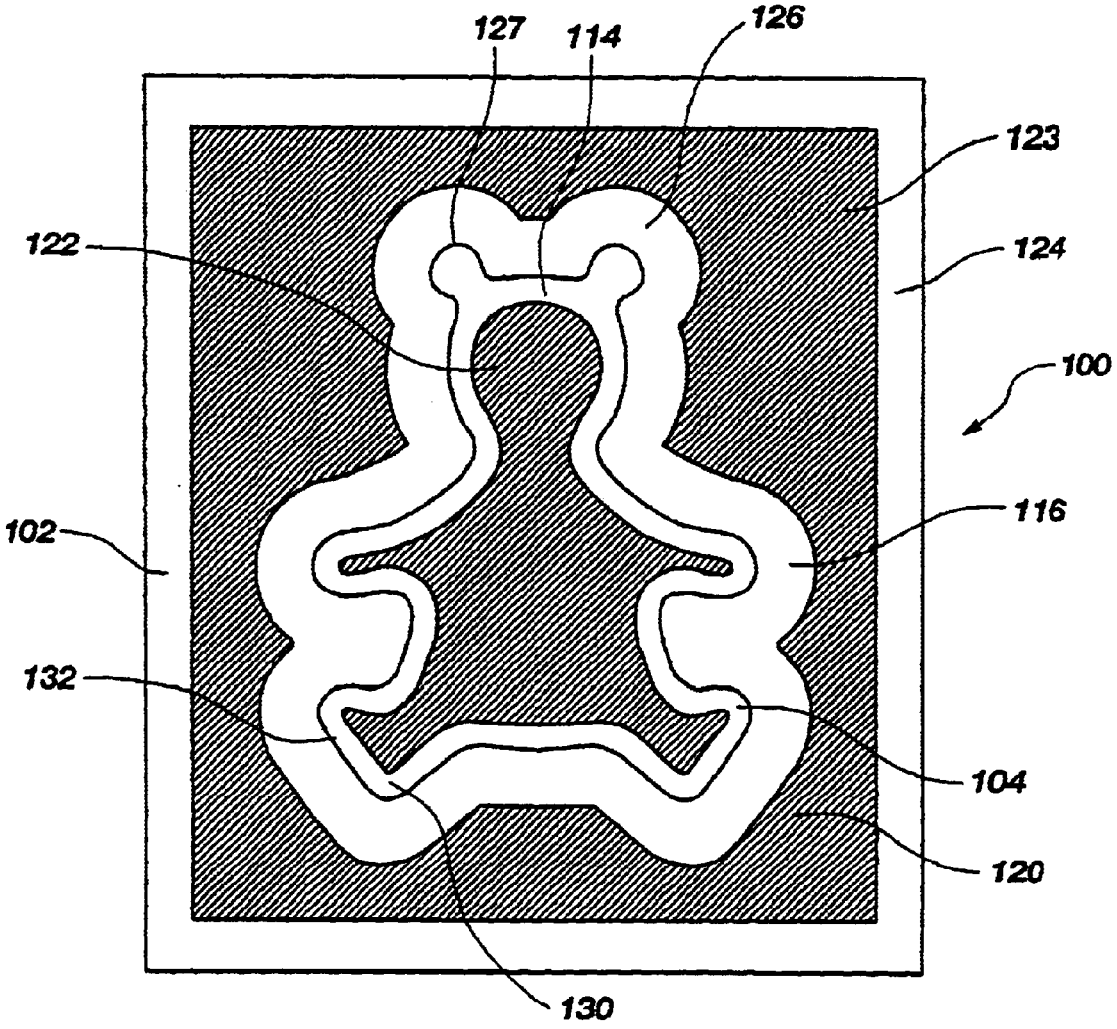
FIG. 3B is a back view of the die cutting block shown in FIG. 3A.

As illustrated in FIG. 3B, which shows the back side of the die cutting block 100, the back surface 114 of the insert portion 104 is substantially flush with the back surface 116 of the base portion 102. Furthermore, the base portion 102 and insert portion 104 are formed with cavities 120 and 122, respectively, to limit the amount of material necessary to form the die cutting block 100. In this preferred embodiment, the base portion 102 and insert portion 104 are formed from plastic, such as ABS high impact styrene. The base portion 102 includes an outer wall 124 which depends from the top plate 123 and extends around the perimeter of the base portion 102. The base portion 102 also includes an inner wall 126 which provides structural support for the blade (not visible) and thus has an inner contour 127 to substantially match the contour of the blade. Likewise, the insert portion 104 has an outer wall 130 which extends around the perimeter of the insert portion 104 having an outer contour 132 which is configured to substantially match the inner contour 127 of the inner wall 126. Indeed, it is preferable that the inner wall 126 and the outer wall 130 proximate the back side 116 of the base portion 102 form an interference fit (i.e., fit tightly together when the insert portion 104 is fully inserted into the base portion 102).

Preferably, the base portion 102 and insert portion 104 are formed by an injection molding process such as those injection molding processes known in the art. Unlike the prior art die cutting blocks which are formed from wood, the molded plastic components of the present invention provide for much higher production rates for the plastic components as well as allow for the use of less expensive materials (i.e., such plastic parts are much cheaper than similar parts made from wood).

In this preferred embodiment, the blade 106 has been formed into the outline of a teddy bear FIG. 112. This particular FIG. 112 is presented by way of example only and is not intended in any way to limit the scope of the present invention. Upon review of the present invention as described herein, those of skill in the art will quickly appreciate that the FIG. 112 may comprise any conceivable shape.

The die cutting block 100 is utilized to cut paper into the shape of the figure by pressing the blade 106 against a sheet or sheets of paper (not shown). The pressing action may be performed with various die cut pressing machines known in the art.

Figure 4:
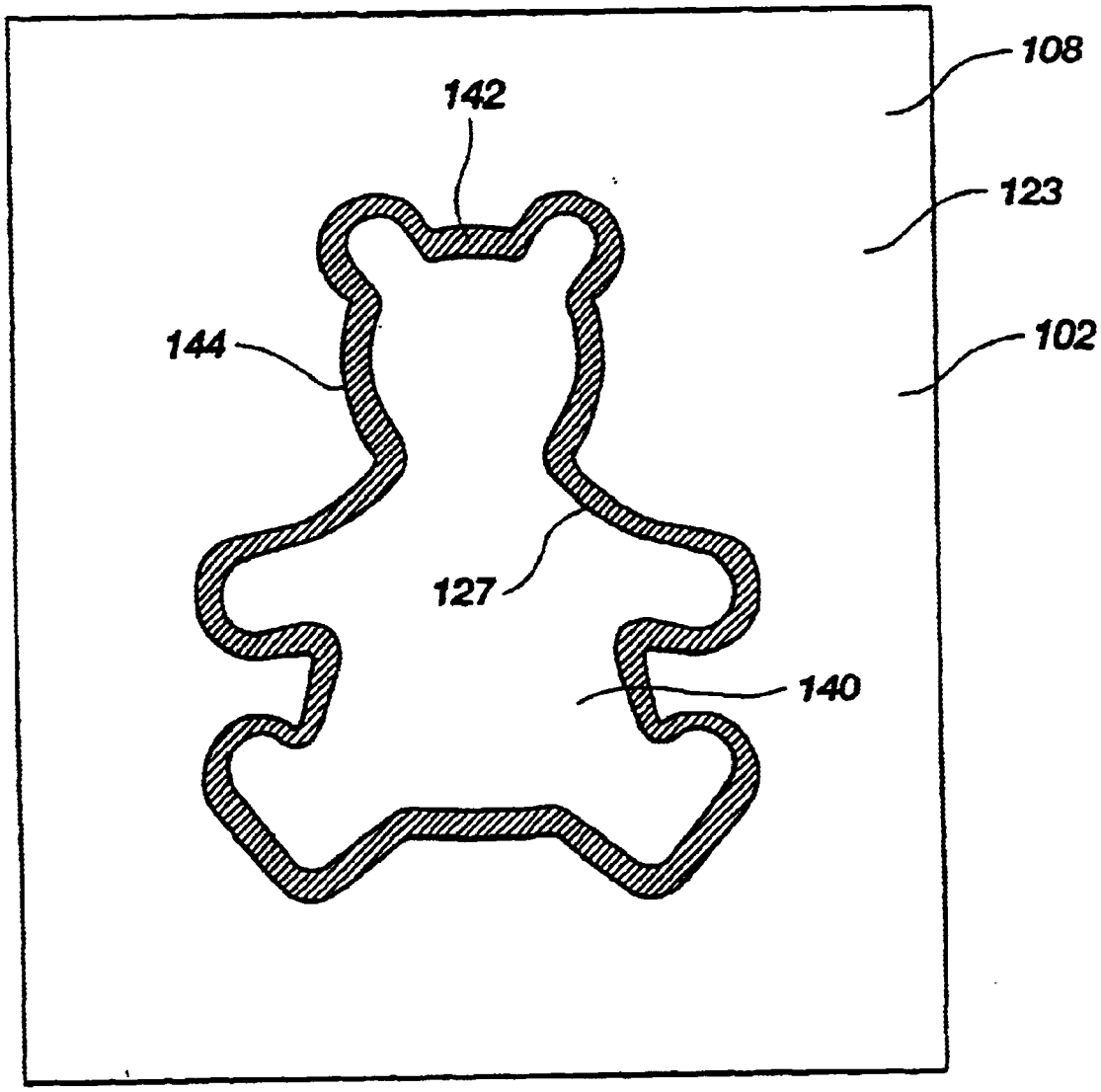
FIG. 4 is a front view of the base portion of the die cutting block shown in FIG. 3A.

Referring now to FIG. 4, the base portion 102 has a top plate 123 which forms the top surface 108. The base portion 102 defines an aperture 140 which is configured to receive the blade 106 (see FIG. 3A) having a desired shape, in this case the outline of a teddy bear. Recessed within the aperture 140 is a lip or ledge 142 which extends around the interior 144 of the aperture 140. The ledge 142 is spaced from the top surface 108 and provides an abutment for supporting the blade 106 and preventing it from falling through or being forced through the back side of the base portion 102.

Figure 5:
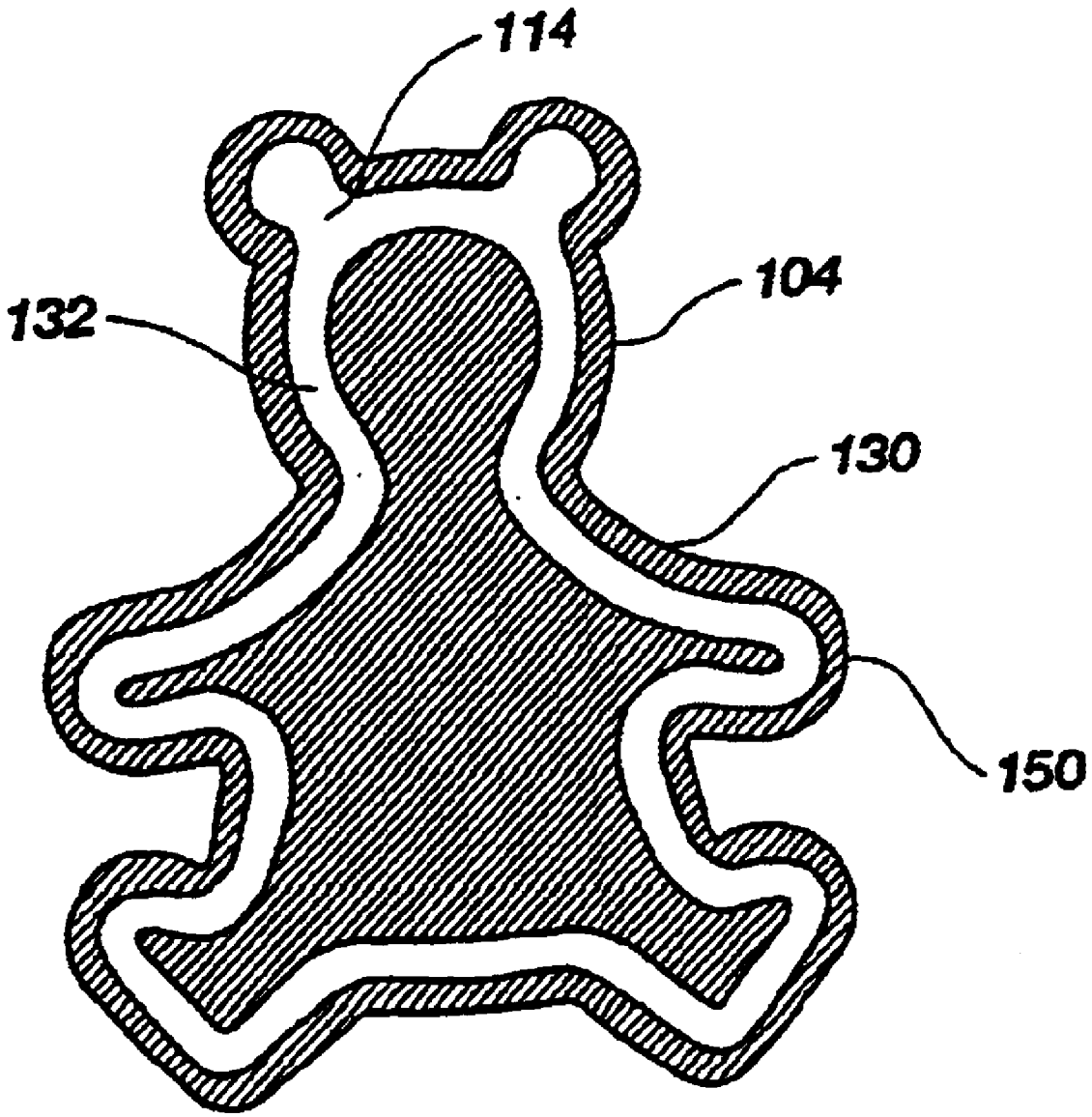
FIG. 5 is a front view of the insert portion of the die cutting block shown in FIG. 3A.

As shown in FIG. 5, which illustrates the back side of the insert portion 104, the back surface 114 defines the outer contour 132 configured to match the inner contour 127 defined by the ledge 142 of the base portion 102 shown in FIG. 4. The outer wall 130 of the insert portion 104 defines a recess or inset which extends around the perimeter of the back surface 114. When the insert portion 104 is inserted into the base portion 102, the outer contour 132 of the back surface 114 fits within the inner contour 127 of the ledge 142. Likewise, the outer perimeter 150 of the insert portion 104 is sized and shaped to fit within and substantially match the contour of the interior 144 of the aperture 140 of the base portion 102. While the outer contour 132 fits snugly within the inner contour 127, the outer perimeter 150 is spaced away from the interior surface 144 of the aperture 140 so as to allow clearance for receiving the blade 106 therein between. The blade 106, however, fits tightly between the insert portion 104 and the base portion 102 so that when the insert portion 104 is fully inserted into the base portion 102, neither the blade 106 nor the insert portion 104 can be easily removed from the base portion 102.

Figure 6:
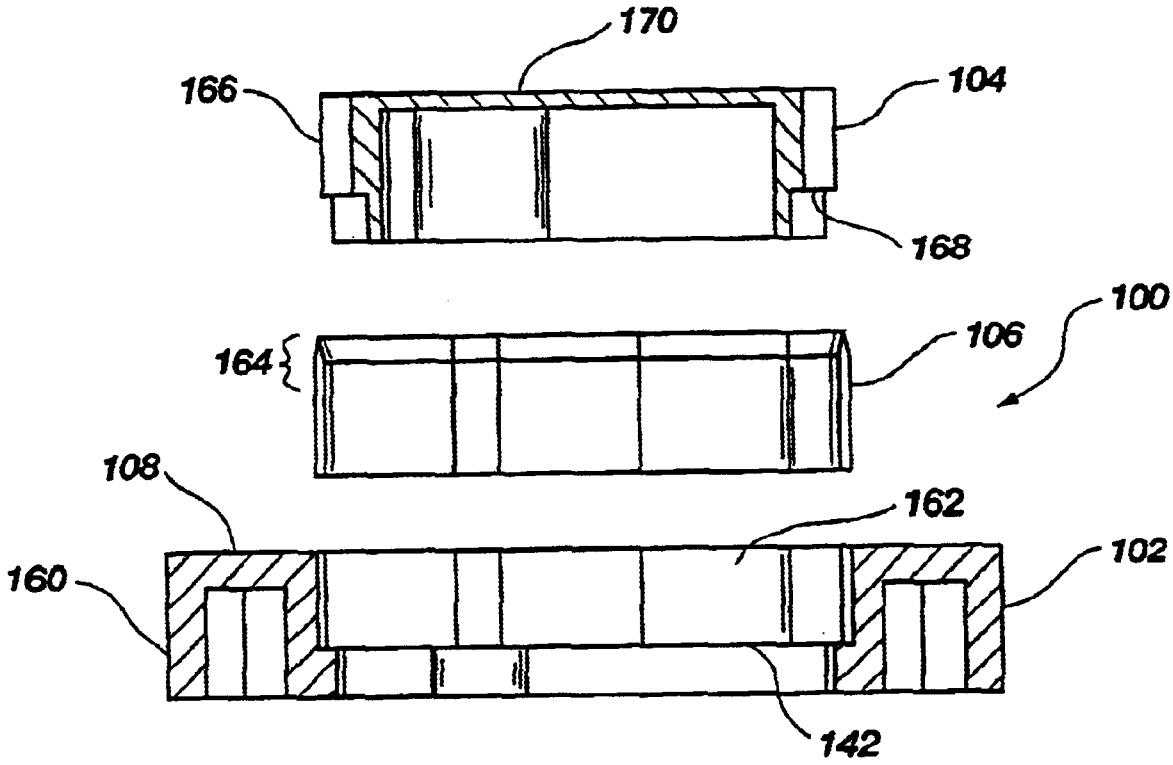
FIG. 6 is an exploded cross-sectional side view of the die cutting block shown in FIG. 3A.

FIG. 6 shows an exploded cross-sectional side view of the die cutting block 100 in accordance with the principles of the present invention. In order to assemble the die cutting block 100, the base portion 102 is placed upon a supporting surface (not shown). The blade 106 is then inserted into the base portion 102. In this example, the blade 106 is formed from two mirrored sections of blade, each comprising half of the desired shape of the figure. Thus, one half of the blade 106 is inserted into the right side 160 of the base portion 102 and the other half of the blade (not shown) would be inserted into the left side of the base (not shown). Those of skill in the art will appreciate that the blade may be comprised of one or more segments. The blade 106 will then rest upon the ledge 142. As illustrated, the blade 106 is preformed to substantially match the interior contoured surface 162 of the base portion 102. Once inserted, a top portion 164 of the blade 106 will extend above the top surface 108 of the base portion 102.

The insert portion 104 is then inserted into the base portion 102 such that the blade 106 is interposed between the interior contoured surface 162 of the base portion 102 and the outer contoured surface 166 of the insert portion 104. The insert portion 104 is then forced into the base portion 102 as by applying pressure or an abrupt force to the top surface 170 of the insert portion 104. The insert portion 104 is forced into the base portion 102 until the abutment surface 168 contacts the ledge 142. Conversely, the insert portion 104 could be inserted into the base portion 102 and the blade 106 then inserted into the space between the base portion 102 and the insert portion 104. Still yet, the blade 106 may be pressed onto the outside of the insert portion 104 and the assembled blade and insert then inserted into the base portion 102.

Figure 7:
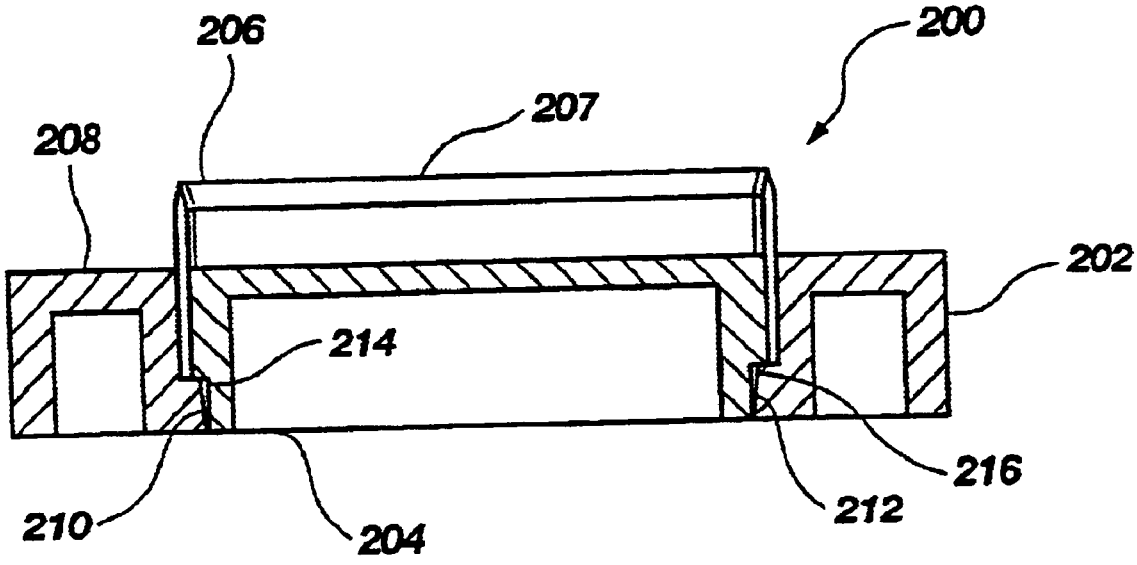
FIG. 7 is a cross-sectional side view of a second embodiment of a die cutting block in accordance with the principles of the present invention.

As shown in FIG. 7, a die cutting block 200 in accordance with the principles of the present invention include a blade 206 having nearly any conceivable shape. In this case, the blade 206 is configured to form a simple circular shape. The blade 206 is wedged and thus tightly secured between the base portion 202 and the insert portion 204. The blade 206 is sharped at its top edge and forms a planar to surface 207 which defines the shape cut by the blade when the blade is pressed against a sheet or sheets of paper (not shown). While the base and insert portions 202 and 204, respectively, are preferably formed from plastic so that such components can be injection or otherwise molded, the blade 206 is preferably formed from steel. When the blade 206 is pinched between the base portion 202 and the insert portion 204, the resilience and springiness of the steel blade 206 forms a biasing locking member between the insert and base portion making it difficult to disassemble the die cutting block 200 once assembled.

It may also be preferably to provide an interference fit between the base portion 202 and the insert portion 204. This is accomplished by forming a male/female engagement between the lower portion of the insert portion and the bottom portion of the base portion. The male/female engagement is formed between the outer surface 210 of a wedge or inset portion 214 and the inner surface 212 of the ledge 216. In order to facilitate engagement between the outer surface 210 and the inner surface 212, the inner surface 212 is inwardly tapered from its top to its bottom. As such, as the inset portion 214 is forced into the inner surface 212, the engagement between the two surfaces 210 and 212 becomes tighter. This engagement helps keep the base portion and insert portion secured relative to one another once assembled. Of course, those of skill in the art will appreciate that this tapered feature to tighten engagement between the base portion and the insert portion may be accomplished also by inwardly tapering the surface 210 of the wedge portion.

Because the blade 206 also helps keep the insert and base portions 204 and 202 held tightly together, it is also contemplated that the insert portion 204 has a thickness that is the same as the distance from the top of the ledge 216 to the top surface 208. In such a case, the insert portion 204 would not extend past the top surface of the ledge 214.

Figure 8A:
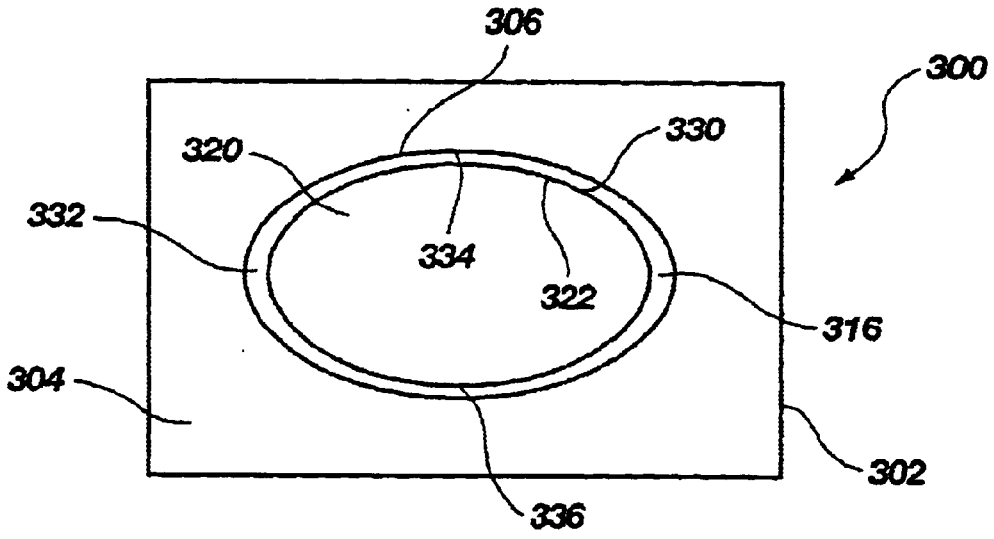
FIG. 8A is a top view of a third embodiment of a die cutting block in accordance with the principles of the present invention.
Figure 8B:
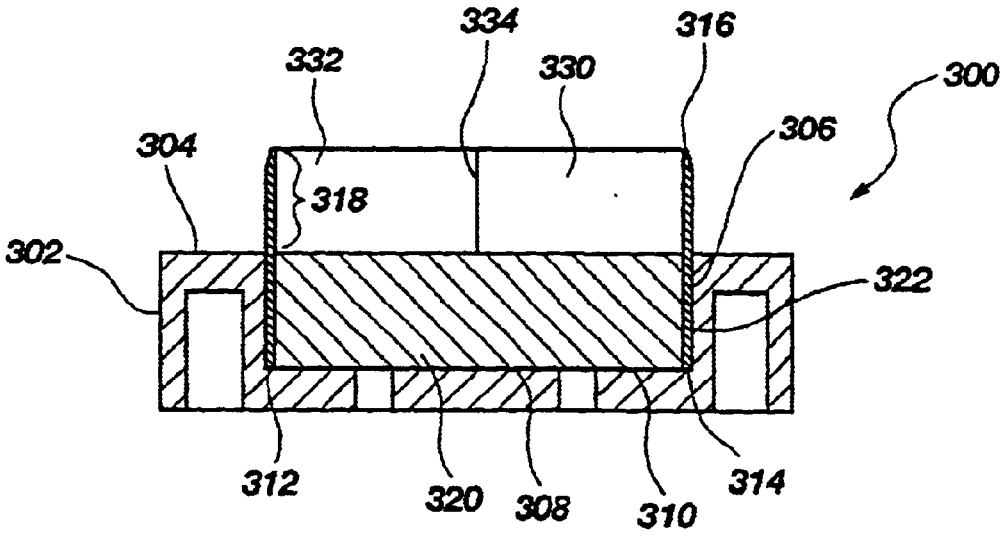
FIG. 8B is a cross-sectional side view of the die cutting block of FIG. 8A.

FIGS. 8A and 8B illustrate another preferred embodiment of the present invention of a die cutting block 300 of the present invention. The die cutting block 300 includes a base portion 302 having a top surface 304 and an inner wall surface 306 defining a recess 308. The bottom 310 of the recess 308 forms an abutment 312 for supporting the bottom edge 314 of the blade 316. The blade 316 is partially inserted within the recess 308 so that a portion 318 of the blade 316 extends above the top surface 304 of the base portion 302.

An insert portion 320 is inserted within the recess 308 of the base portion 302 such that the blade 316 is interposed between the inner wall surface 306 of the recess 308 and an outer surface 322 of the insert portion 320. The insert portion 320 provides an interference fit between the inner wall surface 306, the blade 316 and the outer surface 322 of the insert portion 320. It should be noted that without the blade 316, the insert portion 320 fits loosely within the base portion such that there is a space between the base portion and the insert portion. When the blade 316 is formed to have a desired shape (an oval in this case), the blade will likely not exactly match the contour of the inner wall surface 306 or the outer surface 322 of the insert portion 320. Because the blade is preferably formed from steel rule which is inherently spring-like, the blade 316 will remain in a somewhat flexed state when inserted between the base portion 302 and the insert portion 320. This flexed state has a biasing effect between the base portion 302 and the insert portion 320 to tightly hold the base portion 302 relative to the insert portion 320. Thus, while the insert portion 320 forms a wedge within the recess to force the blade against the inner wall surface 306 of the base portion 302, the spring-like properties of the blade 316 are what hold the die cutting block 300 together once assembled without the need for adhesives or other types of mechanical fasteners.

While the insert portion 320, blade 316, and the recess 308 of the base portion 306 are illustrated as having similar shapes, the blade 316 is the only component that must hold its preformed shape so that it can cut an intended shape.

Thus, so long as the insert portion 320 and the base portion 302 can hold the blade in this shape, the insert portion 320 and base portion 302 can take on various shapes and configurations. For example, the insert portion 320 could be configured to include various recesses and indentations about its perimeter while still providing an effective outer shape to hold the blade 316 within the recess 308. Likewise, the inner wall surface 306 of the base portion 302 could provide various points of contact against the blade 316 to hold the blade in place but does not have to provide continuous contact about the blade's perimeter.

As further illustrated in FIGS. 8A and 8B, the blade 316 may be formed from a plurality of segments 330 and 332 that are welded together with welds 334 and 336. By welding the blade 316 into a singular component prior to assembly of the die cutting block 300, the assembly process is simplified compared to the assembly process of the prior art heretofore described. That is, there is no need to work with multiple blade segments that could become improperly inserted within the recess 308 or that could get overlapped or, more likely, leave gaps between segments. Any such gaps, would result in uncut portions when using the die cutting block 300.

Figure 9:
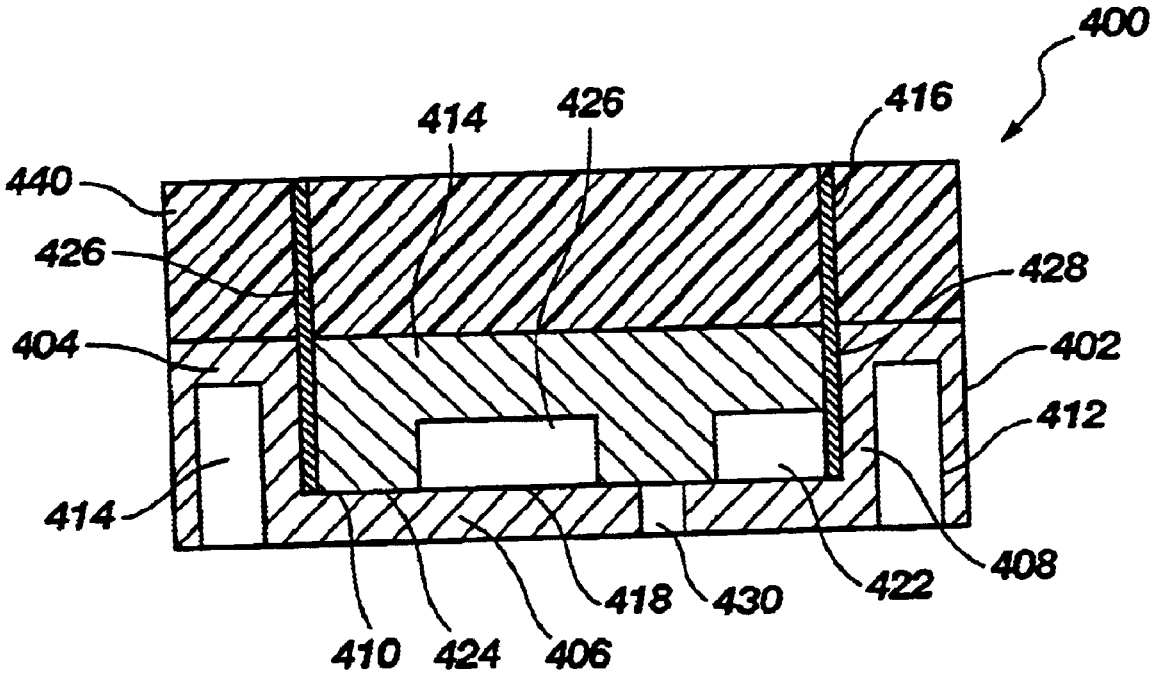
FIG. 9 is a cross-sectional side view of a fourth embodiment of a die cutting block in accordance with the principles of the present invention.

FIG. 9 illustrates yet another preferred embodiment of a die cutting block 400 of the present invention. While the base portion 402 could be formed from a solid piece of material, in order to utilize less material for its formation, the base portion 402 of the device is formed from a top plate 404, and a bottom plate 406 interconnected by an inner wall 408. The inner wall 408 and bottom plate 406 define a recess 410 within the base portion. An outer perimeter wall 412 extends around the top plate 404 and defines an inner space 414 between the outer perimeter wall 412 and the inner wall 408. As with the other embodiments described herein, an insert 414 is inserted within the base 402 to hold a blade 416. The insert portion 414 only abuts against the bottom surface 418 of the recess 410 at various points since the insert 414 is provided with recesses 420 and 422 along its bottom surface 424. The insert portion 414 does, however, provide outer surfaces 426 and 428 that impinge upon the blade 416.

If it is necessary to remove the insert portion 414 to replace or realign the blade 416, as may be the case in the assembly process, at least one aperture or hole 430 is provided in the bottom plate 406 to provide access to the bottom surface 424 of the insert 414 so that the insert 414 can be dislodged. To protect the user from the sharp edges of the blade 416 and to eject the material being cut from the inside of the blade, an ejection material is attached to the to surface or face of the die cutting block 400. The ejection material is preferably a foam rubber 440 having an open cell configuration and extends above the top edge of the blade 416 so that when the back of the block 400 is pressed against a material, the foam rubber 440 is compressed to expose the cutting edge of the blade 416. When the block 400 is removed from the material being cut, the ejection material 440 on the inside of the blade expands to eject any cut material and to recover the cutting edges of the blade 416.

Figure 10:
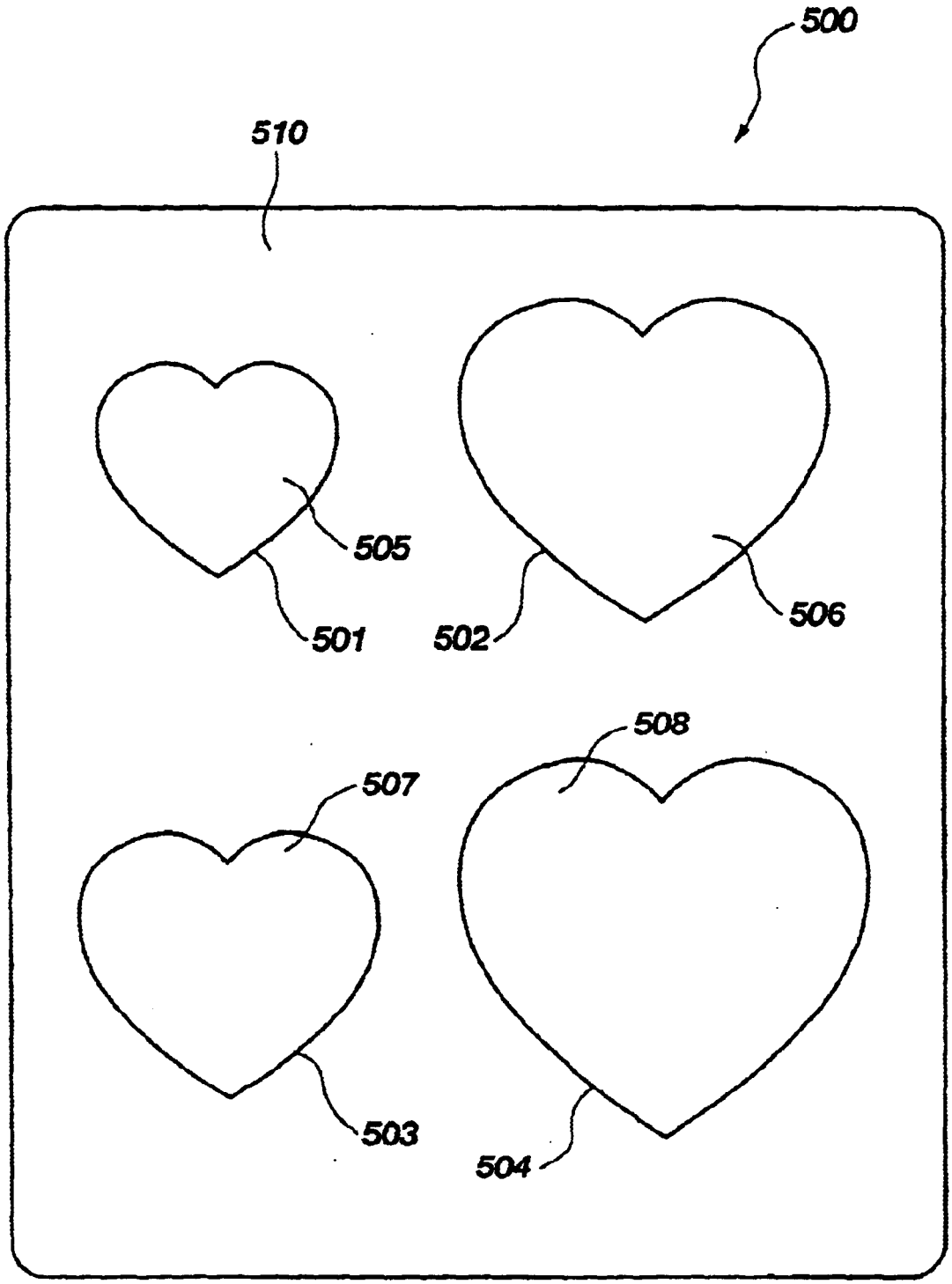
FIG. 10 is a top view of a fifth embodiment of a die cutting block in accordance with the principles of the present invention.

Referring now to FIG. 10, another embodiment of a die cutting block 500 in accordance with the present invention is illustrated. In this embodiment, the block 500 is provided with a single base 510 housing a plurality of blades 501–504 and a plurality of inserts 505–508. With such a configuration, a plurality of shapes can be cut from a single pressing of the block 500. Thus, it is contemplated in accordance with the present invention that a single die cutting block 500 can be configured provide for cutting of multiple shapes.

Figure 11A:
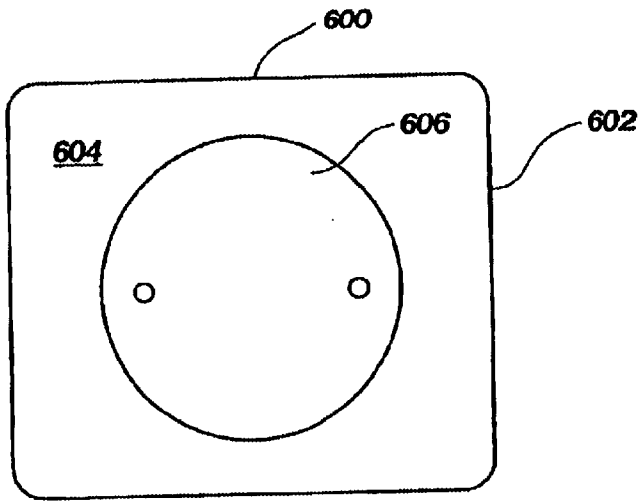
FIGS. 11A and 11B are top and cross-sectional side views, respectively, of a sixth embodiment of a base for a die cutting block in accordance with the principles of the present invention.
Figure 11B:
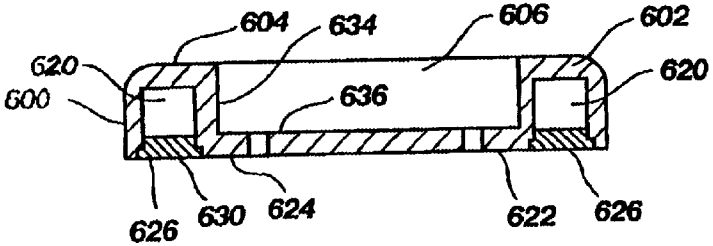

As shown in FIGS. 11A, 11B, 12A, 12B, 13A and 13B, a die cutting apparatus, in accordance with the principles of the present invention, may include multiple blades for forming interior cuts. The base 600 shown in FIGS. 11A and 11B is configured similarly to that illustrated with respect to FIG. 8B. For simplicity of illustration, the die cutting apparatus of FIGS. 11A–13B is configured to cut two concentric circles. It is contemplated, however, that such teachings may be applied to form die cutting apparatuses in accordance with the principles of the present invention to form other shapes in which interior cuts are desired. For example, die cutting apparatuses for cutting out letters could utilize such interior cuts to cut out center portions such as the center triangularly shaped portion of the letter A or the "D" shaped interior portions for such letters as B, D, P, and R.

Figure 13A:
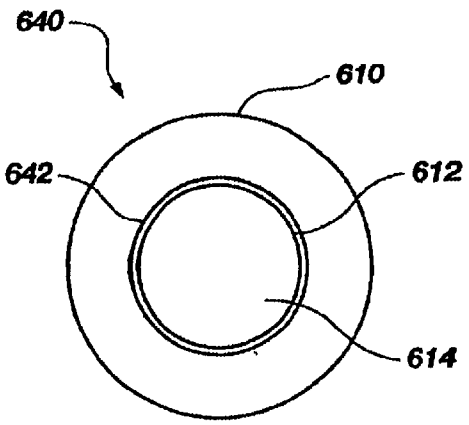
FIGS. 13A and 13B are top and cross-sectional side views, respectively, of a sixth embodiment of an insert assembly for a die cutting block in accordance with the principles of the present invention.
Figure 13B:
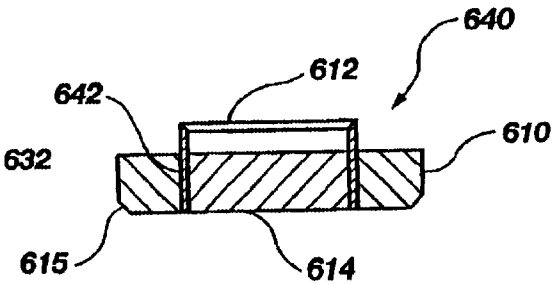
Figure 12A:
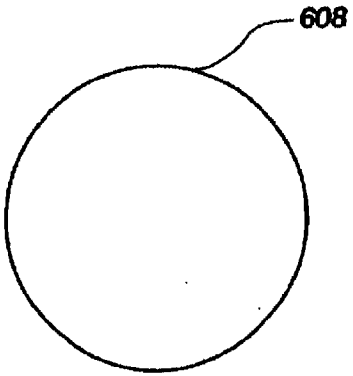
FIGS. 12A and 12B are top and cross-sectional side views, respectively, of a sixth embodiment of a blade for a die cutting block in accordance with the principles of the present invention.
Figure 12B:
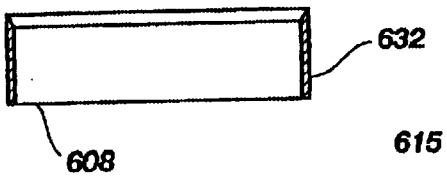

The base 600 is comprised of a base member 602 defining a top surface 604 and a recess 606 formed therein. The recess 606 is configured to receive a first blade 608 (FIGS. 12A and 12B), a first insert 610, a second blade 612 and a second insert 614 (FIGS. 13A and 13B). The base member 602 is provided with a perimeter recess 620 on its underside 622. In order to provide a substantially continuous bottom surface 624 on the underside 622, a backside insert 626 configured to match the contour of the recess 620 is fitted within the recess 620 such that a bottom surface 630 of the insert 626 is substantially flush with the bottom surface 624. What has been referred herein as the underside 622 with reference to FIGS. 11A and 11B is actually to the top of the die cutting apparatus 600 in use. That is, the blades 608 and 612 will be placed face down against one or more sheets of material to be cut such that the surface 624 is facing up. As such, the cutting edges of the blades 608 and 612 lie in substantially the same plane so that the blades 608 and 612 substantially equally cut into the material being cut.

The first blade 608 is provided to make an outermost cut of the desired shape and is sized to substantially fit within the recess 606 such that the outside surface 632 of the blade 608 fits relatively snugly against the interior wall 634 of the recess 606. The height of the blade 608 is configured to extend above the top surface 604 while abutting against the bottom surface 636 of the recess 606. The optimal height of the blade is determined by the thickness and type of material used to form the blade so that the blade 606 can maintain structural integrity while being pressed against one or more sheet of material without bending. It is desirable, however, to provide a relatively thin blade that will maintain its cutting edge even after extended use.

As previously discussed, in order to provide an interior cut, an insert assembly, generally indicated at 640, is provided. The insert assembly 640 is configured to fit within the blade 608. The insert assembly 640 is comprised of the first insert 610 and a second insert 614 with a second blade 612 interposed between the first insert 610 and the second insert 614. The bottom perimeter edge 615 of the first insert 610 may be chamfered or rounded to facilitate insertion within the blade 608. In this particular embodiment, the second insert 614 is seated within the first insert 610 with the first insert 610 defining an aperture 642 for receiving the second blade 612 and the second insert 614, but it should be appreciated that the configuration of the second blade and second insert may have any one of an endless number of configurations, including configurations that do not require the second insert to be fully encased by the first insert.

Figure 14:
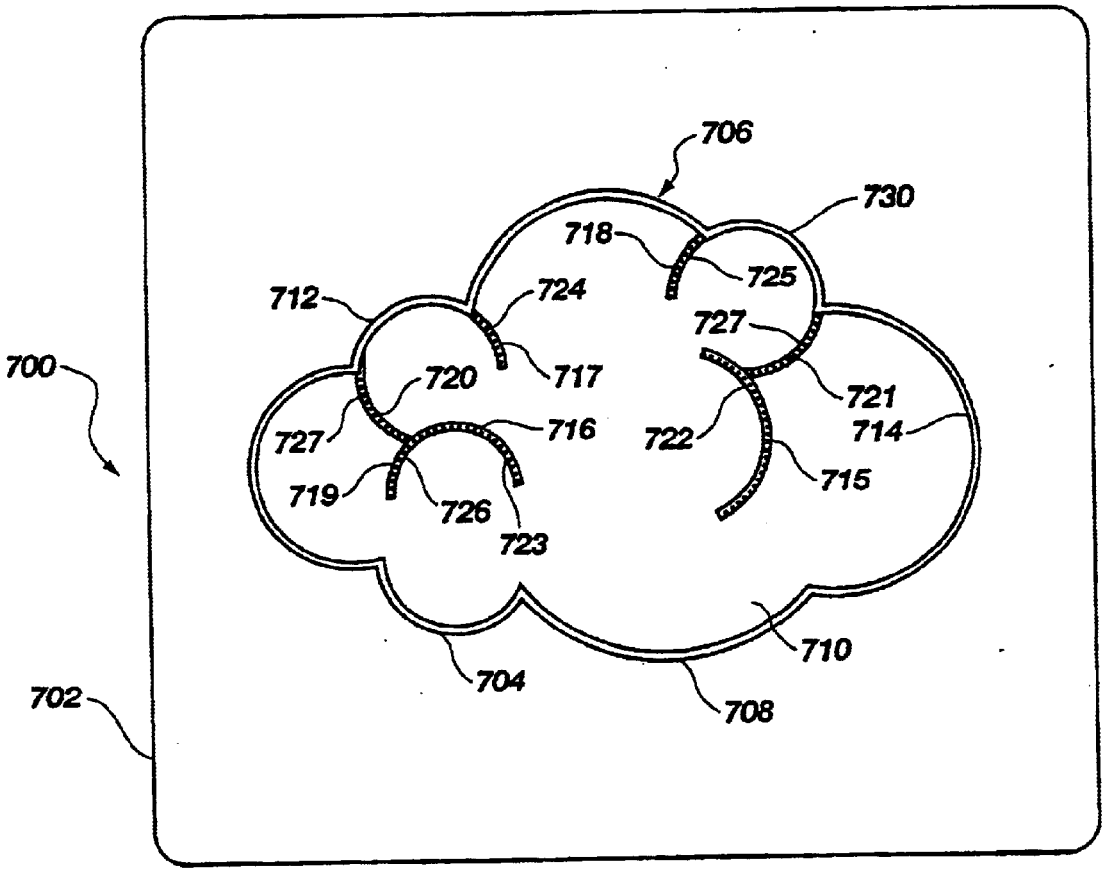
FIG. 14 is a top view of a seventh embodiment of a die cutting block in accordance with the principles of the present invention.

FIG. 14 illustrates yet another embodiment of a die cutting apparatus, generally indicated at 700, in accordance with the principles of the present invention. The die cutting apparatus is comprised of a base portion 702 which defines a recess 704 therein for receiving an insert assembly, generally indicated at 706. In this embodiment, the insert assembly 706 is comprised of an outer blade 708 which defines the outer configuration of the shape to be cut by the die cutting apparatus 700. An insert 710 is provided to hold the blade 706 by friction fit within a channel or slot defined between the outer wall 712 defining the recess 704 and the outside surface or wall 714 of the insert 710. In order to provide additional interior features, such as perforated cuts, punches or crease rule to outline features in the shape being cut without making a complete cut through the die cut material, blades 715–721 are fitted within interior slots or channels 722–727, respectively, that are formed in the insert 710. The slots 722–727 allow for the blades 716–721 to be inserted therein and held in place relative to the insert 710. These inner blades 715–721 may be provided with an irregular top cutting edge so as to form perforations in the material being cut or with a dulled edge so as to crease the paper without cutting through the paper. Thus, the blades 715–721 may provide perforated cuts in the material being cut to accentuate various features in the die cuts without completely cutting a continuous cut in the material. The perforation blades 715–721 may be formed from separate sections of blades or may be integrally formed into the outer blade 708. For example, the blades 718 and 721 may be formed with the outer blade portion 730 with parts of the blade providing perforating edges and part of the blade providing a continuous edge.

Figure 15:
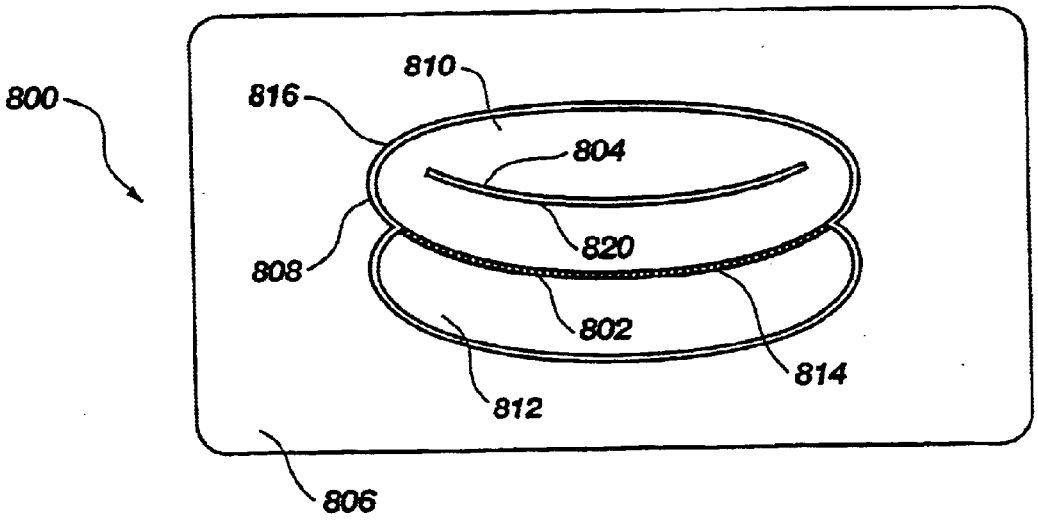
FIG. 15 is a top view of an eighth embodiment of a die cutting block in accordance with the principles of the present invention.

As further shown in FIG. 15, a die cutting apparatus, generally indicated at 800 in accordance with the principles of the present invention, may include both a perforating interior cutting blade 802 and a non-perforating or continuous interior cutting blade 804. In this example, the base 806 provides an interior recess 808 that receives a first insert 810 and a second insert 812. The first and second inserts 810 and 812 are separated by a perforating blade 814 that is held in place by the first and second inserts 810 and 812. The perforating blade 814 extends from proximate a left side of the outer blade 816 to proximate a right side of the outer blade 816. The first insert 810 is provided with an elongate slot 820 that is interior to the first insert 810. The slot is configured to receive and hold the blade 804 therein. The slot 820 preferably extends completely through the insert 810 but may only extend partially into the insert 810. The blades 802 and 804 are provided to provide interior detail to the shape being cut.

While the blades forming the interior cuts described herein have been illustrated as being comprised of elongate, thin blade members, it is also contemplated that such blade members may be formed from punch type members such as those found on paper punches and the like. For example, if it is desired to cut eyes out of a sheet of material that is being die cut into the shape of a person or animal, elongate posts may be received within the insert holding one of the blades. The elongate posts may then be provided with sharpened edges for punching a hold in the material being cut. Furthermore, the posts may be held in place by providing a countersunk hole in the back of the insert with the post having a wider portion held in place by the countersunk portion of the hole in the insert. Once the insert is held in place by the base portion, such posts would be prevented from falling out of the insert. It should also be noted that the primary blade need not form a continuous, enclosed shape. The desired shape may be formed from a combination of continuous cuts and perforated cuts as my be desired.

While the methods and apparatus of the present invention have been described with reference to certain preferred embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. The claims provided herein are intended to cover such modifications and combinations and all equivalents thereof. Reference herein to specific details of the illustrated embodiments is by way of example and not by way of limitation.

What is claimed is:

1. A die cutting block, comprising:

a base portion having a top surface and an inner wall surface, said inner wall surface defining a recess and having an abutment within said recess, said abutment comprising a ledge portion depending inwardly from said inner wall surface proximate a lower end thereof;

a first blade at least partially inserted within said recess and at least partially supported by said abutment, said first blade partially extending above said top surface; and a first insert portion inserted within said base portion wedging said first blade within said recess of said base portion.

2. The die cutting block of claim 1, wherein said base portion and said first insert portion are comprised of plastic.

3. The die cutting block of claim 1, wherein said recess, said first blade and said first insert portion are each formed to have a similar shape.

4. The die cutting block of claim 1, wherein said base portion is comprised of a top plate, a perimeter wall depending from said top plate, and an inner wall depending from said top plate, said inner wall defining said recess.

5. The die cutting block of claim 1, wherein said abutment ledge portion extends substantially completely around said inner wall surface.

6. The die cutting block of claim 5, wherein said abutment ledge portion forms a bottom plate member.

7. The die cutting block of claim 1, wherein said first insert portion defines a first outer surface defining an outer contour to substantially match an inner contour of said recess, a size of said outer contour being sufficient to wedge said first blade against at least a portion of said inner wall surface of said base portion.

8. The die cutting block of claim 7, wherein said recess extends through said base portion and wherein said abutment forms a ledge extending around an inner surface of said recess, and wherein said first insert portion is further defined by a wedge portion at a lower end thereof sized to engage with an inner surface of said ledge for holding the first insert portion relative to the base portion.

9. The die cutting block of claim 8, wherein said inner surface of said ledge is tapered from proximate its top to proximate its bottom.

10. The die cutting block of claim 8, wherein said wedge portion is tapered from proximate its top to proximate its bottom.

11. The die cutting block of claim 1, wherein said first insert portion defines a slot therein and further including a second blade held within said slot.

12. The die cutting block of claim 11, wherein said second blade is comprised of at least one of a perforating blade and a crease rule.

13. The die cutting block of claim 11, wherein said slot is entirely interior to said first insert portion.

14. The die cutting block of claim 1, further including a second insert portion inserted within said recess and a second blade interposed between said first insert portion and said second insert portion.

15. The die cutting block of claim 14, wherein said second insert portion is received within said first insert portion.

16. An apparatus for forming die cuts, comprising:

a base having a top surface, an inner surface defining a recess, and at least one ledge portion depending inwardly from said inner surface for supporting a blade during a die cutting process, said ledge being spaced from said top surface of said base;

at least one insert positioned at least partially within said recess; and at lease one blade interposed between said inner surface and said at least one insert, at least partially extending above said top surface, and, said at least one blade resting upon said ledge portion, said at least one blade having an exposed cutting edge defining a desired shape.

17. The apparatus of claim 16, wherein said base and said insert are comprised of plastic.

18. The apparatus of claim 16, wherein said inner wall surface is contoured to substantially match said desired shape, said at least one blade comprised of a plurality of blade members held together with a plurality of welds to form said desired shape.

19. The apparatus of claim 16, wherein said base is comprised of a top plate, a perimeter wall depending from said top plate and an inner wall defining said inner wall surface, said perimeter wall and said inner wall having distal ends lying in substantially a same plane.

20. The apparatus of claim 16, wherein said ledge portion defines a bottom plate.

21. The apparatus of claim 20, wherein said bottom plate defines at least one aperture extending there through for providing access to a bottom surface of said insert.

22. The apparatus of claim 16, wherein said insert wedges said blade against said base and wherein said insert includes a wedge portion at a lower end thereof sized to engage with said ledge portion for holding the insert relative to the base.

23. The apparatus of claim 16, wherein said ledge portion has an inwardly tapered surface from proximate its top to proximate its bottom.

24. The apparatus of claim 23, wherein said wedge portion defines an outwardly tapered surface for engaging with said inwardly tapered surface of said ledge portion.

25. The apparatus of claim 16, wherein said at least one insert defines at least one slot therein and further including at least one additional blade held within said at least one slot.

26. The apparatus of claim 25, wherein said at least one additional blade comprises a cutting edge for forming at least one of perforations and creases.

27. The apparatus of claim 25, wherein said at least one slot is entirely interior to said at least one insert.

28. The apparatus of claim 16, further including at least one additional insert inserted within said recess and at least one additional blade interposed between said at least one insert and said at least one additional insert.

29. The apparatus of claim 28, wherein said at least one additional insert is received within said at least one insert.

30. A die cutting block, comprising:

a base portion having a top surface and an inner wall surface, said inner wall surface defining a recess and having an abutment within said recess;

a first blade at least partially inserted within said recess and at least partially supported by said abutment, said first blade partially extending above said top surface; and a first insert portion inserted within said base portion wedging said first blade within said recess of said base portion said first insert portion comprising a first outer surface defining an outer contour to substantially match an inner contour of said recess, a size of said outer contour being sufficient to wedge said first blade against at least a portion of said inner wall surface of said base portion, said recess extending through said base portion and wherein said abutment forms a ledge portion depending inwardly from said inner wall surface and extending around an inner surface of said recess.

31. The die cutting block of claim 30, wherein said first insert portion is further defined by a wedge portion at a lower end thereof sized to engage with an inner surface of said ledge for holding the first insert portion relative to the base portion.

32. The die cutting block of claim 30, wherein said inner surface of said ledge is tapered from proximate its top to proximate its bottom.

33. The die cutting block of claim 30, wherein said wedge portion is tapered from proximate its top to proximate its bottom.

34. The die cutting block of claim 30, wherein said base portion and said first insert portion are comprised of plastic.

35. The die cutting block of claim 30, wherein said recess, said first blade and said first insert portion are each formed to have a similar shape.

36. The die cutting block of claim 30, wherein said base portion is comprised of a top plate, a perimeter wall depending from said top plate, and an inner wall depending from said top plate, said inner wall defining said recess.

37. The die cutting block of claim 30, wherein said ledge extends substantially completely around said inner wall surface.

38. The die cutting block of claim 37, wherein said ledge forms a bottom plate member.

* * * * *